US006827378B1

(12) United States Patent
Wong

(10) Patent No.: US 6,827,378 B1
(45) Date of Patent: Dec. 7, 2004

(54) ANIMAL EXCREMENT PICKUP DEVICE

(76) Inventor: William Wong, 43-12 Forley St. #2, Elmhurst, NY (US) 11373

( * ) Notice: Subject to any disclaimer, the term of this patent is extended or adjusted under 35 U.S.C. 154(b) by 0 days.

(21) Appl. No.: 10/713,972

(22) Filed: Nov. 14, 2003

(51) Int. Cl.[7] ..... A01K 29/00
(52) U.S. Cl. ..... 294/1.4
(58) Field of Search ..... 294/1.3, 1.4, 19.1; 119/161

(56) References Cited

U.S. PATENT DOCUMENTS

| | | | | | |
|---|---|---|---|---|---|
| 3,841,686 | A | * | 10/1974 | Gallo et al. | 294/1.4 |
| 3,929,363 | A | * | 12/1975 | Kahan | 294/1.4 |
| 4,200,319 | A | * | 4/1980 | Cooper | 294/1.4 |
| 4,323,272 | A | | 4/1982 | Fortier | 294/1.4 |
| 4,368,907 | A | * | 1/1983 | Ross | 294/1.4 |
| D281,108 | S | | 10/1985 | Wilson | D30/162 |
| 5,186,506 | A | | 2/1993 | Gale | 294/1.3 |
| 5,380,054 | A | | 1/1995 | Galvis | 294/1.4 |
| D368,003 | S | | 3/1996 | Simon | D8/4 |
| 5,503,442 | A | * | 4/1996 | Lee | 294/1.4 |
| 5,601,321 | A | | 2/1997 | Simon | 294/1.4 |
| D384,865 | S | | 10/1997 | Baran | D8/4 |
| 6,062,168 | A | | 5/2000 | Host et al. | 119/161 |
| 2002/0185874 | A1 | * | 12/2002 | Arceo | 294/1.4 |

* cited by examiner

*Primary Examiner*—Robert P. Swiatek
(74) *Attorney, Agent, or Firm*—Daniel Kirshner, Esq.

(57) ABSTRACT

A device for picking up animal excrement or other refuse that includes a disposable replaceable collection box placed in a saddle box. The saddle box is attached to an elongated handle which includes an outer tubular member surrounding an inner shaft. The saddle cooperates with chambers molded outward on the exterior of the disposable box to control opening and closing of the disposable box. A button like switch protrudes through the outer tubular member of the handle and is attached to the inner shaft member. Downward force applied to the switch transmits the force through the inner shaft, and causes downward motion of a pusher plate attached to the end of the inner shaft. The pusher plate applies the force to the disposable box through a ridge on the top of the box, thereby causing outward deflection of the side walls of the saddle box and inducing the box to open to receive dung. A pair of segregating flaps are attached to the interior of the box so that when the device is inverted, the flaps segregate the dung in the top portion of the box and prevent its falling out. In this manner another pile of refuse can be collected. The device presents the advantage that the user can replace the disposable box with inexpensive, easily molded replacement boxes by shaking the disposable box out from the saddle box and replacing it.

6 Claims, 4 Drawing Sheets

ANIMAL EXCREMENT PICKUP DEVICE

FIELD OF THE INVENTION

The present invention is a device for picking up animal excrement. More specifically, the present invention is a hand-held device that includes a disposable excrement retaining box and at least one internal retention flap for segregating excrement so that a user can clean up several droppings before disposal of the box.

BACKGROUND OF THE INVENTION

Many people have dogs or other pets and need to take these dogs out for walks so that the dogs can relieve themselves. In urban or suburban areas, the pet owners are typically required by law to clean up after their dogs and also do so as a matter of courtesy and sanitation.

It is a common sight to witness dog owners walking their dogs carrying empty plastic bags and employ these plastic bags to pick up their dog's waste. The practice of utilizing empty plastic bags presents significant disadvantages. It is unpleasant to make manual contact with dog's excrement, even though protected by an empty plastic bag. Furthermore, plastic bags tend to be flimsy and the dog owner runs the risk of plastic bag breakage, thereby exposing the user to direct contact with the dog waste.

There are a number of prior art devices that people use to expedite and ease the process of cleaning up after their dogs. Generally, these devices assist the dog owner so that the owner may avoid direct contact with the dog's excrement or even indirect contact through a flimsy plastic bag. Furthermore it is well known in the prior art to employ an elongated handle to relieve the burden of bending over. Some prior art devices employ a two-piece assembly wherein a sweeping unit held in one hand is utilized to sweep the excrement into a collection unit held in the opposite hand. Naturally, these two-piece devices posses the disadvantage of occupying both of the user's hands.

Other prior art devices require the user to bend over to pick up excrement. One example of one such prior art devices is disclosed in U.S. Pat. No. 5,186,506 entitled Device for Picking Up and Removing Animal Excrement. This patent shows a device having a pair of elongated tong-like members wherein the user deposits the excrement into a conventional plastic bag for disposal. Other tong-like devices are disclosed in U.S. Design Pat. No. Des. 292,035 for Pet Litter Retriever, and U.S. Design Pat. No. 281,108 entitled Pickup Unit for Animal Droppings.

It would be advantageous to present a device for picking up animal excrement which can be utilized through one-hand operation and without need for the dog owner to bend over while using. It would further be advantageous to present such a device that includes a disposable excrement retainer which can be disposed of along with the collected waste. Furthermore, it would be advantageous to present a device with such a disposable retainer wherein the dog owner could pick up multiple droppings without the need to empty or replace the retainer. Such are the objectives and advantages of the present invention.

SUMMARY OF THE INVENTION

The present invention is a device for picking up animal excrement or other refuse that includes a disposable replaceable collection box formed from deformable plastic. The disposable box is placed in a saddle box molded from somewhat flexible plastic material. The saddle box is attached to an elongated handle which includes an outer tubular member surrounding an inner shaft. The saddle cooperates with chambers molded outward on the exterior of the disposable box to control opening and closing of the disposable box. A button like switch protrudes through the outer tubular member of the handle and is attached to the inner shaft member. Downward force applied to the switch transmits the force through the inner shaft, and causes downward motion of a pusher plate attached to the end of the inner shaft. The pusher plate applies the force to the disposable box through a ridge on the top of the box, thereby causing outward deflection of the side walls of the saddle box and inducing the box to open to receive dung. A pair of segregating flaps are attached to the interior of the box so that when the device is inverted, the flaps segregate the dung in the top portion of the box and prevent its falling out. In this manner another pile of refuse can be collected. The device presents the advantage that the user can replace the disposable box with inexpensive, easily molded replacement boxes by shaking the disposable box out from the saddle box and replacing

BRIEF DESCRIPTION OF THE DRAWINGS

For a better understanding of the invention, reference is made herein to the following description of an exemplary embodiment thereof, considered in conjunction with the following drawings, in which.

DETAILED DESCRIPTION OF THE INVENTION

The present invention is a device for picking up animal excrement that includes a disposable replaceable excrement retaining box. The animal excrement pick-up device can be operated one-handedly and is engineered to be usable to clean up after multiple animals before disposal of the box. Naturally, it is clear that this invention can be utilized to pick up garbage or waste of all types, and is not limited to animal excrement.

Referring to the figures, the excrement pick-up device comprises generally a disposable excrement receiving box 12 and an elongated handle 14 said handle having an inner rod 16 and an outer tubular member 18 which provides the attachment to the mechanism to open and close the disposable excrement box.

Figure 1:
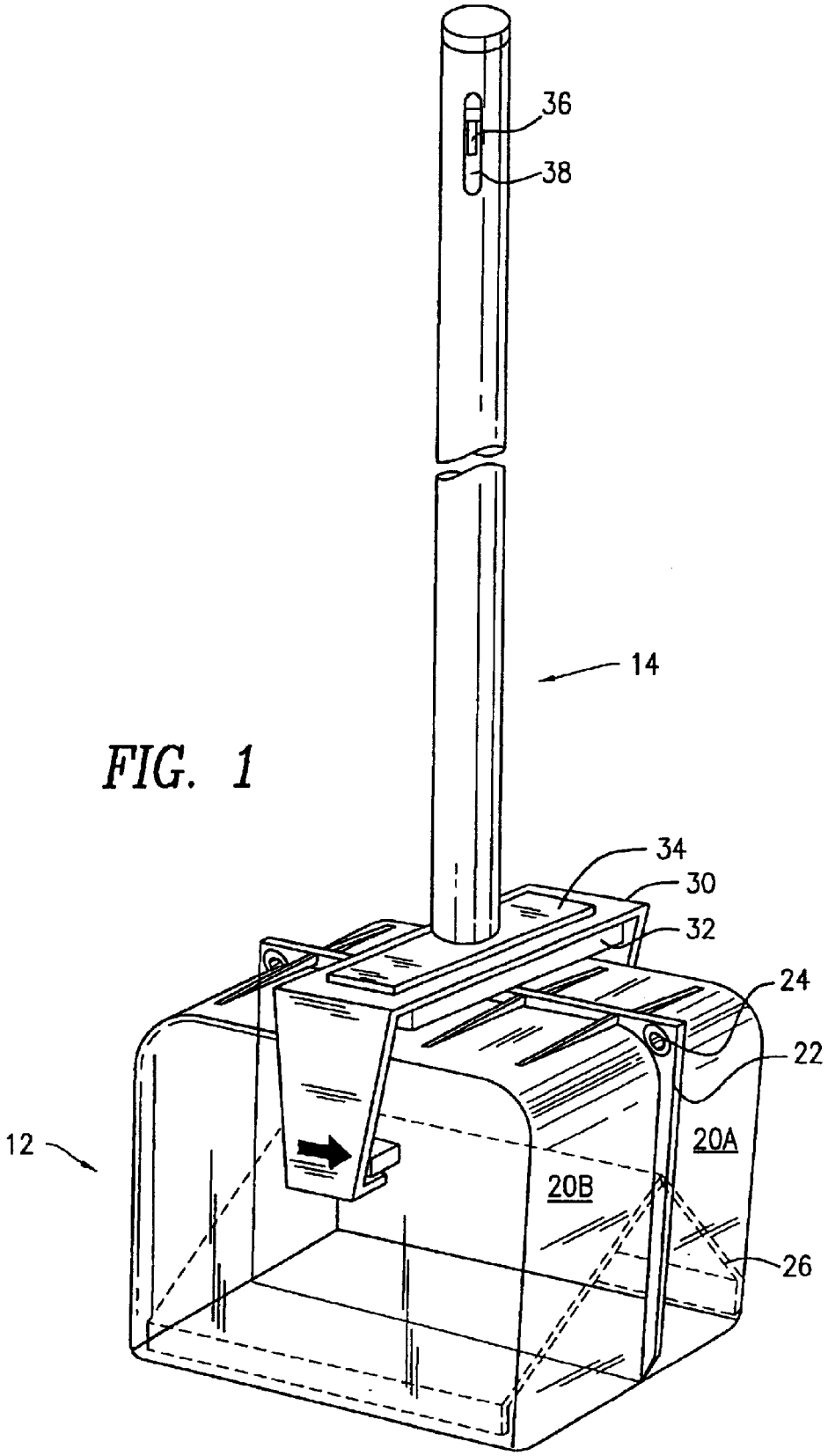
FIG. 1 is a front perspective view of the present invention animal excrement pickup device.
Figure 2:
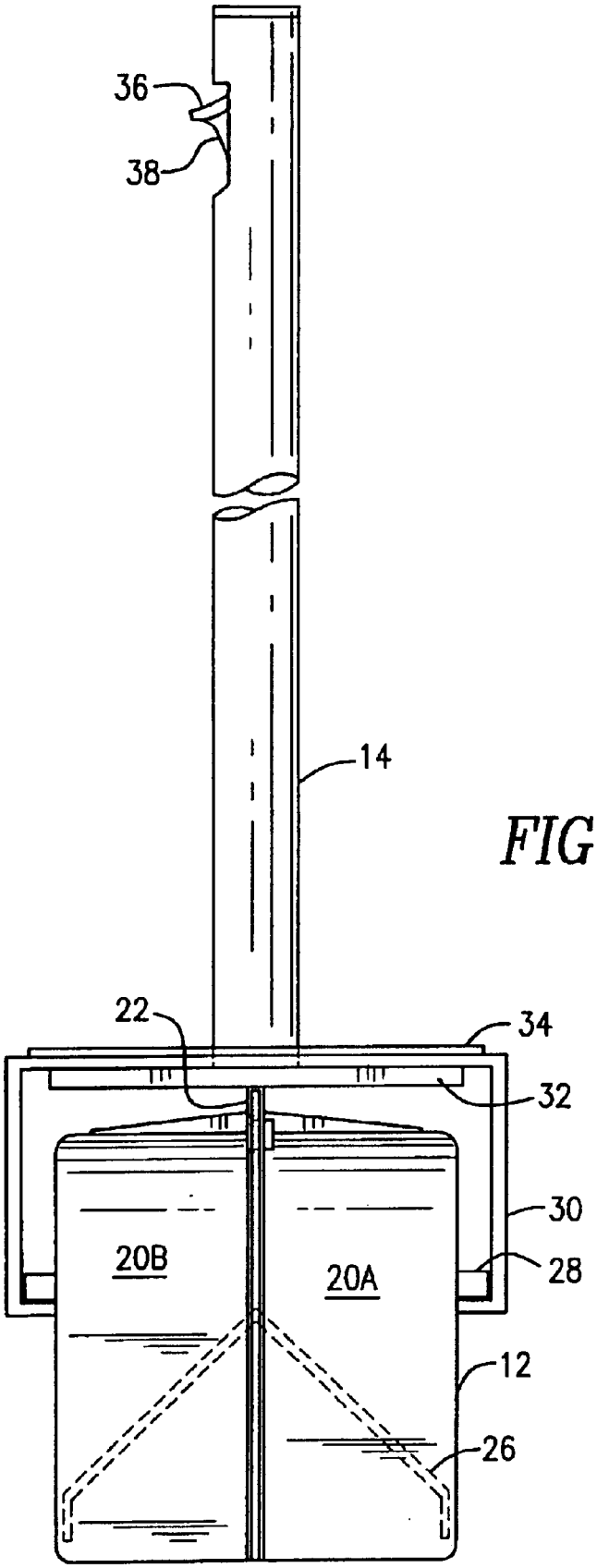
FIG. 2 is a side plan view of the present invention.
Figure 3:
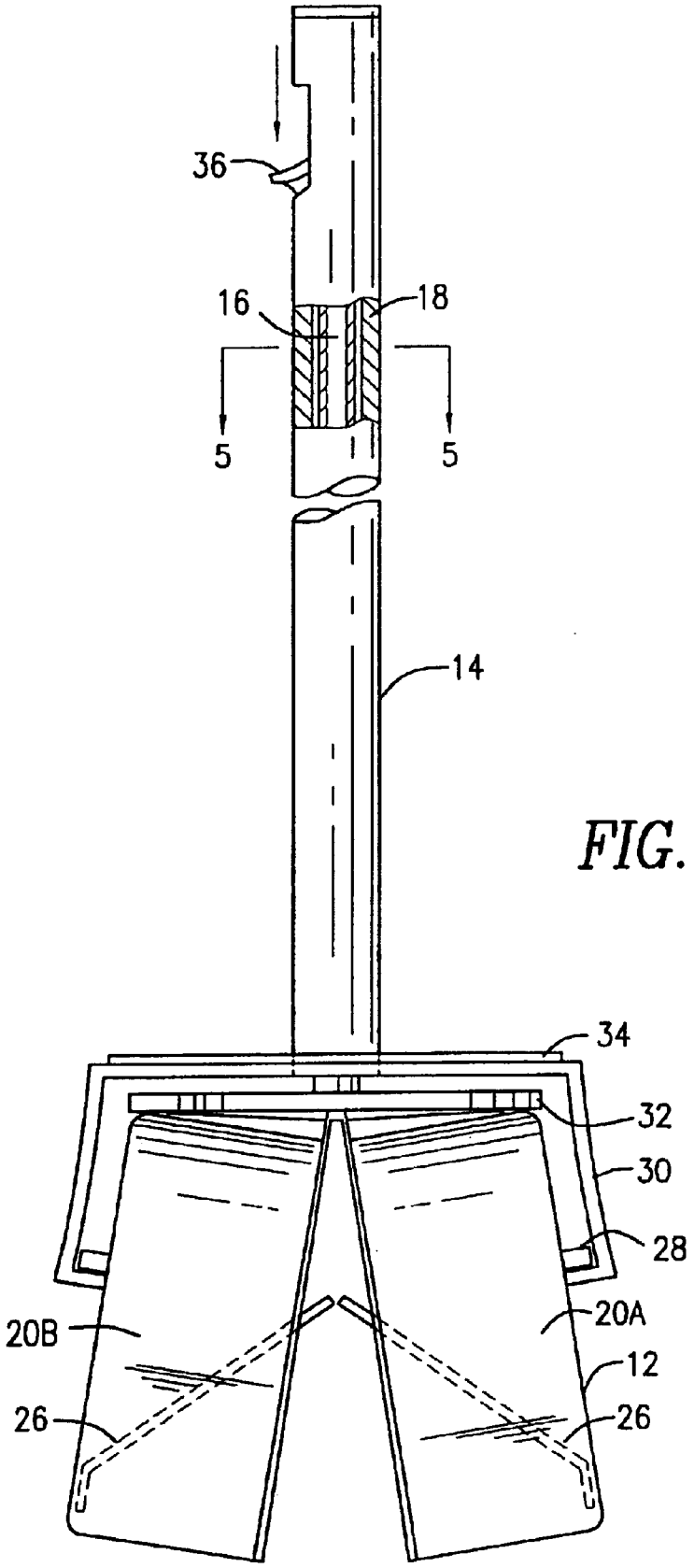
FIG. 3 is side view of the present invention showing the elongated handle in partial cutaway view, the switch engaged and the excrement retainer box in its open position.

Now looking at more specifically at FIGS. 1–3, the disposable excrement retaining box 12 is molded or otherwise formed from deformable plastic or other deformable material. It will be understood that the excrement box is easily mass produced by conventional plastic injection molding techniques and is therefore inexpensive to utilize as a disposable element. The box is formed from two halves 20A and 20B, each of which has a ridge 22 that extends outward from the top and sides of the box. (The ridge does not extend out from the bottom of the box thereby presenting a flat bottom for ease of excrement pick up.) At the two corners of the ridge are disposed molded circular button members 24 for attaching the two halves together. It will be understood that the button members comprise coordinating male and female circular button elements whereby the male member on one half of the box is fitted into the coordinating female member on the other half, thereby snapping the two halves together.

Inside of the excrement retaining box is attached at least one excrement segregating flap 26. In the preferred embodiment shown in the drawings herein, there is a pair of excrement segregating flaps, one attached to each half of the box. Each excrement segregating flap is hingedly attached to the interior wall of the box 12. Specifically, each segregating flap is molded or glued onto the interior of the box and extend upward at the attachment points along the front and back faces of the receptacle (not the side faces where the ridge is located.) The flaps are hinged and bent so that they extend into the interior of the box at an angle of approximately 27° where the flaps meet somewhere in the middle.

Extending substantially perpendicularly outward from the exterior of each half of the disposable box are two molded chambers 28, said chambers formed from the disposable box exactly the way as for the buttons 24.

Figure 4:
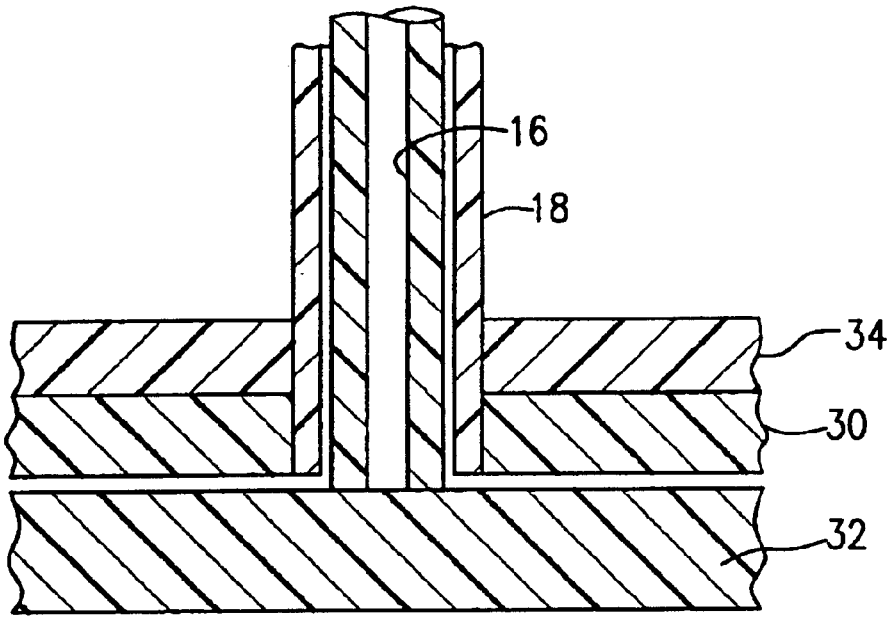
FIG. 4 is a cross-sectional view of the elongated handle showing its inner rod and its attachment to the activator.
Figure 5:
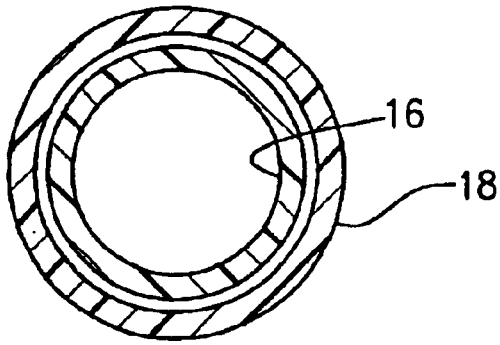
FIG. 5 is a cross-sectional view shown along section 5—5 on FIG. 3 of the elongated handle of the present invention.

The elongated handle 14 comprises an inner cylindrical rod 16 contained within an outer tubular member 18 as shown in a partial cutaway view in FIG. 3 and shown in cross sectional views in FIGS. 4 and 5. Attached to the outer tubular member is a plastic saddles box member 30 to removably hold the disposable excrement box to the handle member. The saddle box is formed from a piece of flexible plastic and has a horizontal stub on each side wall of the saddle box and which should be sized and configured so that it extends slightly wider than the molded chambers 28 of the disposable box. On one side of each horizontal stub there is an upward turn to serve as a stopper to prevent the disposable box from being pushed through and falling out of the saddle box. The horizontal stubs of the saddle box cooperates with the molded chambers 28 of the disposable excrement box. As such, the horizontal stubs of the saddle box should extend far enough on both sides so that it will abut against the molded chambers, yet not so far as to interfere with the disposable excrement box. In any event, the disposable box is removeably held in its place by compression force exerted on the molded chambers as seen in the Figures. More specifically, as the disposable box is deformable, the box is slightly compressed and deformed, although not noticeably, when a replacement box is installed. As such, the molded chambers of the disposable box interact with the horizontal stubs of the saddle box thereby securing the disposable box in place.

A pusher plate 32 is attached to the bottom of the inner rod 16 of the elongated handle and abuts against the ridge at the top of the disposable box. The pusher plate and inner rod member move together. The pusher plate in the preferred embodiment shown is configured as a rectangular piece of rigid material. A rectangular piece of plastic 34 is positioned between the outer tubular member and the saddle box and it is utilized to connect these elements together and to lend structural integrity.

A thumb-operated switch 36 in the nature of a push button is positioned near the top of the elongated handle. The switch is connected to the inner rod of the handle and extends through a long slot hole 38 in the outer tubular member.

Now, the animal excrement pickup device of the present invention is operated in the following manner. When the pet creates a pile of solid droppings, the user presses downward on the switch 36 thereby causing downward deflection of the inner rod of the elongated handle 16 and the connected pusher plate 32. This is best seen in FIG. 3 which shows the switch pressed down and the disposable excrement box in its open position. The pusher plate 32, in turn transmits the downward force to the ridge 22 on the top of the disposable box. The disposable box is arrested from downward motion by the compressive force between the horizontal stubs of the saddle box and molded chamber 28 on the disposable box. As such, the two halves of the disposable box force the side walls of the saddle box outward, thereby separating the halves and thus opening the box to accept excrement. At this time, the user positions the box over the excrement so that the dropping is within the confines of the disposable box.

Next, the downward force on the thumb-operated switch is released (i.e. upward pressure is applied and the button is returned to original position) which in turn releases the downward pressure on the top of the disposable box. As such, the box reverts back into its original configuration and thereby closes. The excrement is now retained within the disposable excrement retaining box.

If the user desires to utilize the present invention for another pet or to clean up another dropping of waste, this invention is suitably adapted to do so. If this is the case, the device is inverted after collection of the first dropping. In other words, the device is positioned so that the disposable excrement receptacle box faces upward and the elongated handle toward the ground. Now, the excrement will deflect the flaps 26 and fall into the top portion of the disposable box. Thereafter, when the device is inverted again, i.e. now the box is directed toward the ground, the excrement is segregated in the top portion of the disposable box by the flaps as the flaps abut against each other and are prevented from deflecting again. Now, the user can employ the device again to pick up more waste, while keeping already-picked-up excrement in the top of the box. As such, the animal excrement pick up device can again be opened and more waste can be cleaned up.

Finally, a significant advantage of this invention is that the disposable excrement box member can be discarded and replaced without making physical contact with the excrement or the disposable box. To do so, the disposable box is positioned over a trash can and the arrow on the saddle is pointed down. Then the device is shaken to dispose of the excrement box and a replacement box is slid in its place. Now the device is ready for use again.

The foregoing is considered as illustrative only of the principles and preferred embodiment of the invention. Furthermore, since numerous changes and modifications will readily occur to one skilled in the art, it is not desired to limit the invention to the exact construction, operation and embodiment shown and described, and accordingly all suitable modifications and equivalents may be resorted to, falling within the scope of the invention.

What is claimed:

1. A device for picking up refuse comprising:

a disposable, deformable refuse container, an elongated handle, said handle having an outer hollow member and inner shaft member contained within said outer member, said inner shaft member having a switch attached thereto, said handle connected to a saddle box, said saddle box utilized to removeably attach said refuse container to said handle, said switch cooperating with said inner shaft member of said handle to exert pressure on said refuse container thereby causing it to deform and to open to accept refuse, and at least one segregating flap within said refuse container for retaining refuse within a segregated area of said refuse container thereby permitting a user to pick up additional refuse within said refuse container, whereby a user may replace said disposable refuse container with a replacement refuse container.

2. The device for picking up refuse of claim 1 wherein said at least one segregating flap for retaining refuse comprises a pair of flaps whereby upon picking up refuse a user inverts said device causing said refuse to deflect said pair of flaps and whereupon re-invertion causes said flaps to abut against each other thereby segregating the refuse.

3. A device for picking up refuse comprising:

a disposable, deformable refuse container, an elongated handle cooperating with said refuse container, said handle having an outer hollow member and inner shaft member contained within said outer member, said inner shaft member of said handle being utilized to exert pressure on said refuse container thereby causing it to deform and to open to accept refuse, and at least one segregating flap within said refuse container for retaining refuse within a segregated area of said refuse container thereby permitting a user to pick up additional refuse within said refuse container, whereby a user may replace said disposable refuse container with a replacement refuse container.

4. The device for picking up refuse of claim 3 further comprising a saddle for removeably attaching said refuse container to said handle.

5. The device for picking up refuse of claim 3 further comprising a switch attached to said inner shaft member said switch cooperating with said inner shaft member to exert pressure on said refuse container causing it to deform and to open to receive refuse.

6. The device for picking up refuse of claim 3 wherein said at least one segregating flap for retaining refuse comprises a pair of flaps whereby upon picking up refuse a user inverts said device causing said refuse to deflect said pair of flaps and whereupon re-invertion causes said flaps to abut against each other thereby segregating the refuse.

* * * * *